United States Patent [19]

Griesmyer

[11] Patent Number: 4,822,017

[45] Date of Patent: Apr. 18, 1989

[54] CARRIER FOR RELATIVELY SMALL SHEETS OF PAPER OR THE LIKE

[76] Inventor: Barbara A. Griesmyer, 11922 Coral Reef, Houston, Tex. 77044

[21] Appl. No.: 796,112

[22] Filed: Nov. 8, 1985

[51] Int. Cl.[4] ..... B65H 5/00

[52] U.S. Cl. ..... 271/2; 271/275; 400/622

[58] Field of Search ..... 271/204, 275, 277, 33, 271/204, 275, 277, 33, 1, 2; 400/635, 622

[56] References Cited

U.S. PATENT DOCUMENTS

| | | | |
|---|---|---|---|
| 1,587,133 | 6/1926 | Anhof | 400/622 |
| 3,175,822 | 3/1965 | Benson | 271/2 |
| 3,262,697 | 7/1966 | Krinke | 271/33 |
| 3,265,556 | 8/1966 | Hungerford et al. | 161/189 |
| 3,504,833 | 4/1970 | Faltin et al. | 255/97 |
| 3,598,397 | 8/1971 | Preisig | 271/12 |
| 3,666,926 | 5/1972 | Conte, Jr. | 235/61.12 R |
| 3,786,984 | 1/1974 | Malenge | 229/69 |
| 3,902,411 | 9/1975 | Gardner | 101/56 |
| 4,020,615 | 5/1977 | Irvine | 53/35 |
| 4,067,566 | 1/1978 | Williams | 271/2 |
| 4,092,920 | 6/1978 | Barnak | 101/77 |
| 4,104,106 | 8/1978 | Hamisch, Jr. | 156/384 |
| 4,123,087 | 10/1978 | Baron | 400/622 |
| 4,146,375 | 11/1983 | Braverman | 206/534.1 |
| 4,210,688 | 7/1980 | Sato | 428/41 |
| 4,274,902 | 6/1981 | Jenkins | 156/344 |
| 4,297,403 | 10/1981 | Smith | 428/42 |
| 4,307,526 | 12/1981 | Wippern | 40/2 R |
| 4,362,100 | 12/1982 | Wu | 101/233 |
| 4,371,157 | 2/1983 | Hunt | 271/2 |
| 4,390,577 | 6/1983 | Brister | 428/42 |
| 4,393,107 | 7/1983 | Jenkins | 428/42 |
| 4,408,906 | 10/1983 | Wallace | 400/104 |
| 4,431,323 | 2/1984 | Kulow | 400/625 |
| 4,448,558 | 5/1984 | Weingarten | 400/529 |
| 4,454,180 | 6/1984 | La Mers | 428/42 |
| 4,475,747 | 10/1984 | Ashby | 282/11.5 A |
| 4,479,316 | 10/1984 | Wippern | 40/2 R |
| 4,487,645 | 12/1984 | Weston | 271/275 |
| 4,598,860 | 7/1986 | Pennock | 400/622 X |

FOREIGN PATENT DOCUMENTS

| | | | |
|---|---|---|---|
| 602352 | 7/1978 | Switzerland | 400/622 |
| 2092994 | 8/1982 | United Kingdom | 400/622 |

*Primary Examiner*—Richard A. Schacher

*Attorney, Agent, or Firm*—Vaden, Eickenroht, Thompson & Boulware

[57] ABSTRACT

A carrier is disclosed for advancing one or more relatively small items such as envelopes, address cards, checks, and the like through a computer printer or word processor printer having a feed mechanism controlled remotely by the computer or word processor. The carrier includes a carrier sheet of a size that the feed mechanism of the printer can handle and at least one strip of non-setting, non-drying, pressure sensitive tacky adhesive attached to the carrier sheet to which the items can be attached and carried through the printer. Vertical and horizontal grid lines and horizontal and vertical location index numbers are printed on the top surface of the carrier sheet. Parallel retaining strips are also provided to hold the items flat against the carrier sheet.

7 Claims, 2 Drawing Sheets

FIG.1
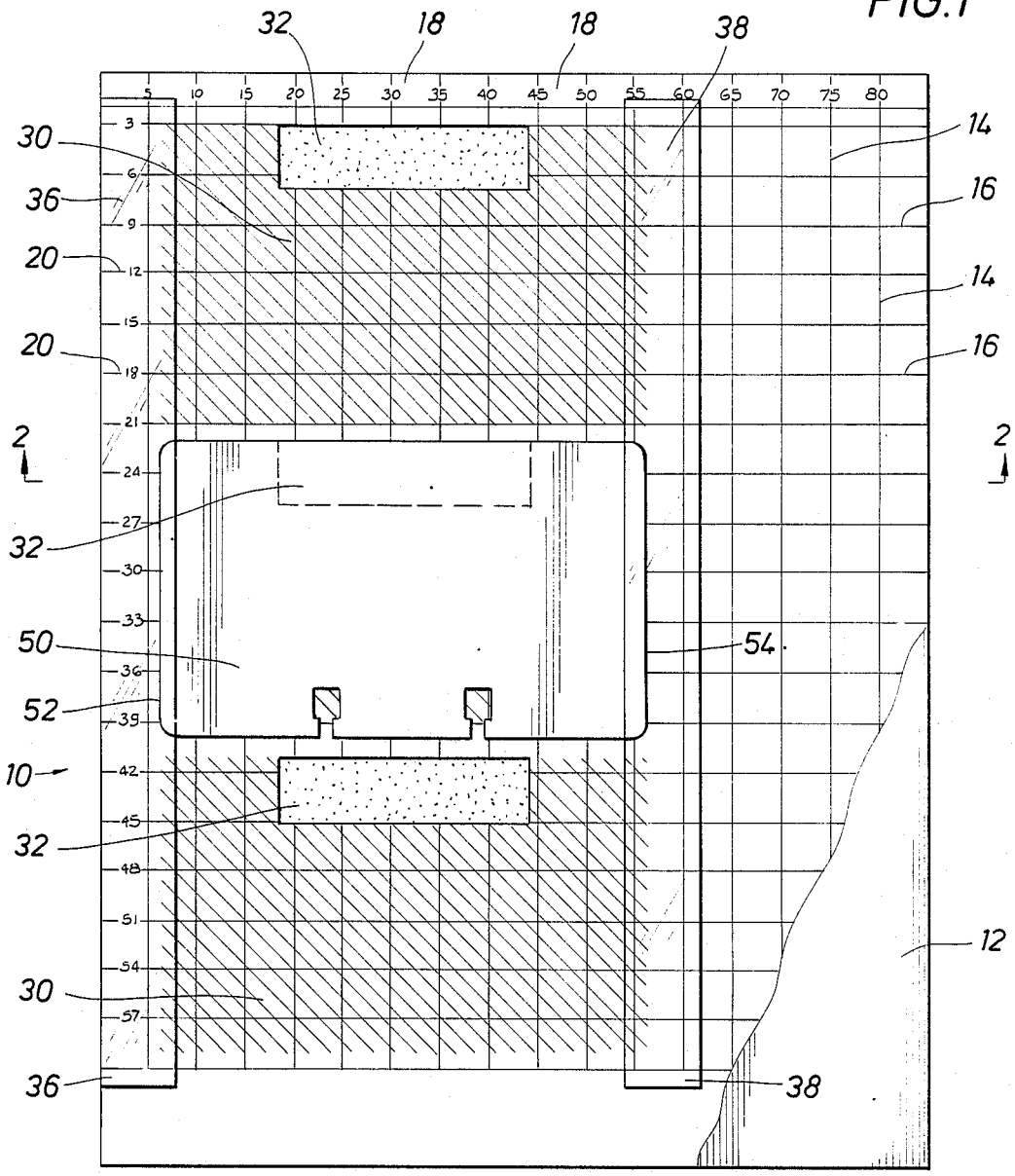
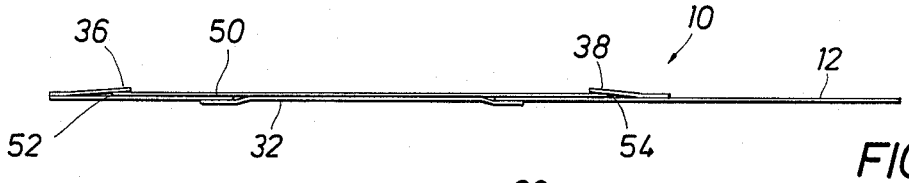
FIG.2
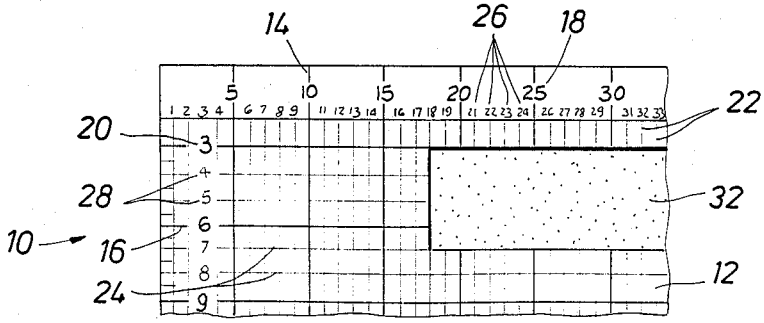
FIG.3

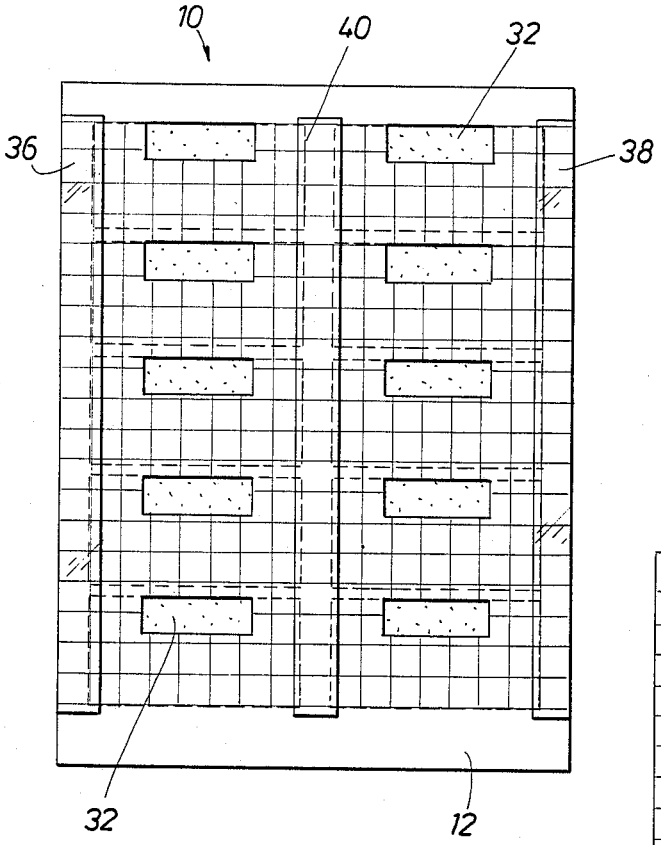
FIG. 4
FIG. 6
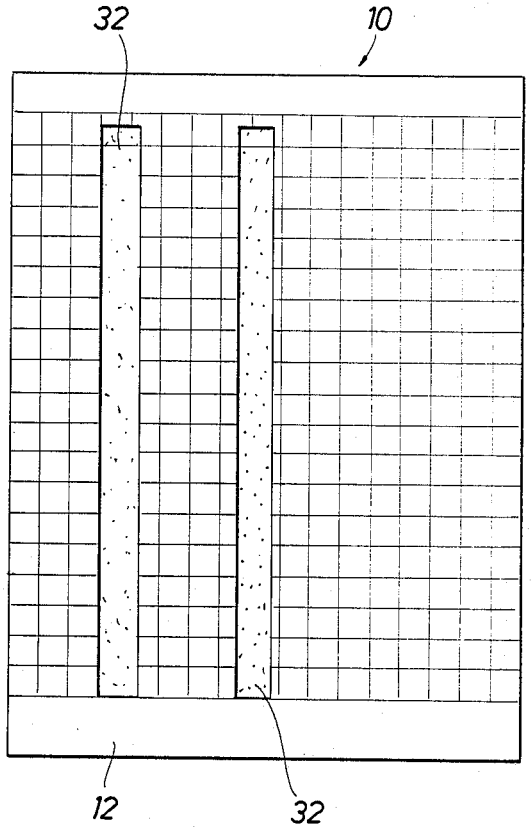
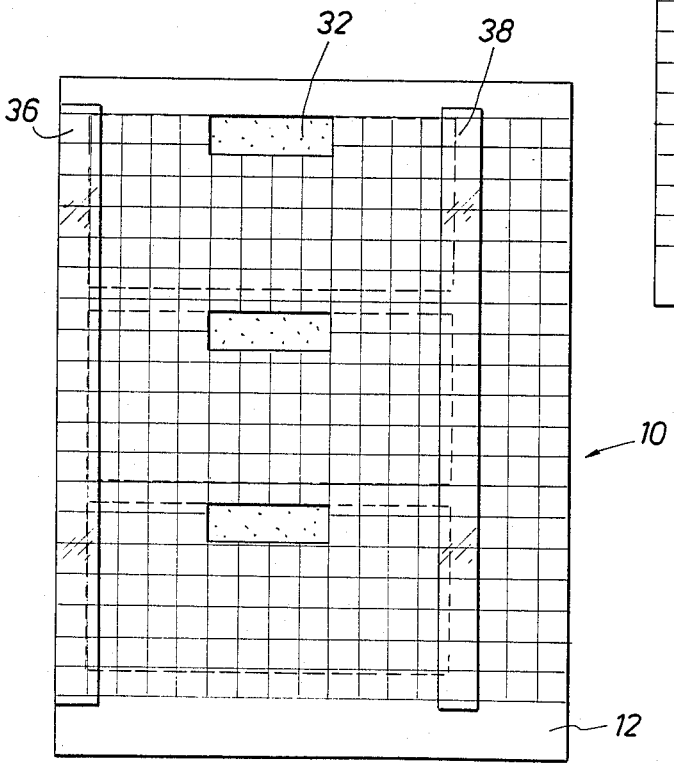
FIG. 5

CARRIER FOR RELATIVELY SMALL SHEETS OF PAPER OR THE LIKE

BACKGROUND OF THE INVENTION

This invention relates generally to means for handling file folder labels, mailing labels, address cards, index cards, postcards, envelopes, checks and other relatively small sheets of paper or the like in an office or other similar environment, and, more particularly, to means for advancing one or more relatively small sheets of paper or the like through a computer printer or word processor printer.

The advent of modern word processing systems, including small multi-purpose computers and dedicated word processors with high speed printers has resulted in the efficient production of documents consisting of one or more sheets of paper of a size and shape for which the carriage and sheet feed mechanism of the particular printer were designed to accommodate. Most printers use automatic feeders that are designed to handle only two sizes of paper, usually 8½ by 11 and 8½ by 13 or 14. Accordingly, it is a common practice for offices that use modern word processing systems to provide one or more conventional typewriters for essentially the sole purpose of typing onto file folder labels, mailing labels, address cards, index cards, postcards, envelopes, checks, and other relatively small sheets of paper.

When one considers the number of offices that are using modern word processing systems, it seems difficult to believe that the prior art has not provided a satisfactory solution to the alignment and other problems associated with advancing a relatively small sheet of paper or the like through the carriage of a computer printer or word processor printer.

It is, therefore, an object of this invention to solve the alignment and provide a carrier for advancing one or more relatively small sheets of paper through a computer or word processor printer.

It is a further object of this invention to provide a carrier of the size that can be handled by the automatic feeders of computer and word processor printers and to which odd-sized items, such as mailing labels, post cards and the like, can be attached to be carried through the printer where the desired information can be printed thereon.

It is a further object of this invention to provide such a carrier that includes one or more strips of adhesive material to which the odd-sized items may be attached for movement with the carrier through the printer and thereafter removed.

It is a further object of this invention to provide such a carrier that includes the adhesive strips and means on each side of the strip for holding the odd-sized items attached to the strip flat against the carrier to ensure smooth passage of the carrier through the feed rollers of the printer without damage to the item.

It is a further object of this invention to provide such a carrier for advancing one or more odd-sized items of a pre-determined size and having an essentially rectangular shape through a computer printer or word processor printer that includes an essentially rectangular sheet of paper or the like of a size that can be handled by the printer having retaining strips located on opposite sides of an adhesive strip to hold the odd sized items attached to the strip flat against the sheet of paper.

It is a further object of this invention to provide such a carrier having horizontal location index numbers and vertical location index numbers printed on the carrier that correspond to the numbers on the margin and tab scale line displayed on the screen of a multi-purpose computer or dedicated word processor during word processing operations and to the line numbers for a computer printer or word processor printer.

SUMMARY OF THE INVENTION

The present invention provides means for advancing one or more odd-sized items such as those noted above through a computer printer or word processor printer. The carrier that is provided by the present invention is particularly suitable for use with a computer printer or word processor printer having a friction sheet feed mechanism. The carrier may be used with a computer printer or word processor printer having a pin sheet feed mechanism if it is fed and advanced in accordance with the principles and teachings of U.S. Pat. No. 4,448,558.

The carrier comprises an essentially rectangular sheet of paper or the like with at least one strip of non-setting, non-drying, pressure sensitive, tacky adhesive exposed on its top surface. The carrier sheet is of a size, typically 8½ inches×11 inches, that the sheet feed mechanism of the computer printer or word processor printer is designed to handle. Vertical and horizontal grid lines and horizontal and vertical location index numbers are printed on the top surface of the sheet so the typist can coordinate the location on the display panel of the information to be printed with the location of the item on the carrier.

Means are provided to hold the items flat on the carrier sheet. In the embodiment shown in the drawings such means are left-hand and right-hand vertical retaining strips affixed to the top surface of the essentially rectangular sheet of paper or the like in embodiments of the carrier that are intended for carrying one or more odd-sized items of a pre-determined size and essentially rectangular shape. In embodiments that are intended for carrying two columns of one or more of such sheets, a central vertical retaining strip is also affixed to the top surface of the essentially rectangular sheet of paper or the like. The inner vertical edges of the left-hand and right-hand vertical retaining strips and both vertical edges of the central vertical retaining strip are free to receive the outer edges of the odd-sized items to hold them flat against the carrier sheet. The strips of non-setting, non-drying, pressure sensitive, tacky, adhesive are disposed between the vertical retaining strips.

In a typical use of the carrier sheet, an odd-sized item is aligned and positioned over a strip of non-setting, non-drying, pressure sensitive, tacky adhesive at an appropriate location on the top surface of the sheet of paper. Then, each of the vertical edges of the odd sized items is inserted between a vertical retaining strip and the top surface of the essentially rectangular sheet of paper. Next, the odd-sized item is pressed onto the adhesive strip. Finally, the carrier is fed into and advanced through the carriage of a computer printer or word processor printer for typing onto the odd-sized items.

These and other advantages, features, and objects of the present invention will be apparent from the following brief description of the drawings, description of the preferred embodiments and claims, and the accompanying drawings.

BRIEF DESCRIPTION OF THE DRAWINGS

FIG. 1 is a top plan view of one embodiment of the carrier of the present invention that is intended for carrying one to three address cards of the type sold under the Rolodex trademark with one such address card secured thereto.

FIG. 2 is a sectional view of the carrier and address card taken along line 2—2 of FIG. 1.

FIG. 3 is a fragmentary top plan view of the top left corner of an alternate embodiment of the carrier of the present invention.

FIG. 4 is a top plan view of a second alternate embodiment of the carrier of the present invention for carrying one to ten file folder labels.

FIG. 5 is a top plan view of a third alternate embodiment of the carrier of the present invention for carrying one to three personal checks.

FIG. 6 is a top plan view of a fourth alternate embodiment of the carrier of the present invention for carrying one or more sheets of paper or the like having a size of shape, or both, that has not been pre-determined.

DETAILED DESCRIPTION OF THE PREFERRED EMBODIMENTS

Carrier 10, which is illustrated in FIG. 1, comprises essentially rectangular sheet 12 or paper or the like having vertical and horizontal grid lines 14 and 16 printed on its top surface. Horizontal location index numbers 18 that correspond to the numbers on the margin and tab scale line displayed on the screen of a typical small multi-purpose computer or dedicated word processor during word processing operations are printed over vertical grid lines 14 near the top of sheet 12. Vertical location index numbers 20 that correspond to the line numbers for every third print line of a computer printer or word processor printer are printed over horizontal grid lines 16 near the left-hand edge of sheet 12. In the alternate embodiment illustrated in FIG. 3, intermediate vertical and horizontal grid lines 22 and 24 and intermediate horizontal and vertical location index numbers 26 and 28 are printed on the top surface of sheet 12. In most embodiments, it is preferable to print shaded areas 30, each having essentially the same size and shape as the particular odd-shaped item that carrier 10 is intended to carry, on the top surface of sheet 12 at appropriate locations, as illustrated in FIG. 1. Sheet 12 is of a size, typically 8½ inches × 11 inches, for which the carriage and sheet feed mechanism of the particular computer printer or word processor printer is designed to accommodate.

In accordance with this invention, adhesive strips are provided to hold the odd-shaped items on the carrier as it travels through the printer. In the embodiment shown in FIG. 1, three strips 32 of non-setting, non-drying, pressure sensitive, tacky adhesive are provided. The actual number, size, and disposition of adhesive strips 32 will vary depending on the number, size, and shape of the particular item that the particular embodiment of the carrier 10 is intended to carry. For example, in the embdoiment illustrated in FIG. 4, ten smaller adhesive strips 32 are provided for carrying one to ten file folder labels. And, in the embodiment of the carrier 10 illustrated in FIG. 5 intended for carrying one to three personal checks, three adhesive strips 32 of approximately the same size as the strips 32 illustrated in FIG. 4 are used. As a final example, in the embodiment illustrated in FIG. 6, two adhesive strips 32 are positioned in spaced, parallel relationship for carrying one or more items of a size or shape, or both, that has not been predetermined.

A wide range of adhesive materials, including many which are commercially available, are suitable for strips 32 of non-setting, non-drying, pressure sensitive, tacky, adhesive. If desired, a suitable adhesive material can be applied directly to the top surface of the sheet 12 to form the adhesive strips 32. Alternately, the adhesive strips 32 can be cut from a tape having a suitable adhesive material on each of its sides and affixed to the top surface of the sheet 12. In the embodiments shown, as illustrated in FIG. 2, adhesive strips 32 are formed by cutting openings in sheet 12 and affixing one or more pieces of tape having a suitable adhesive material on one of its sides to the bottom surface of sheet 12 such that the openings in sheet 12 define the boundaries of the adhesive strips.

In embodiments of the carrier 10 that are intended for carrying items of a pre-determined size and essentially rectangular shape, left-hand and right-hand vertical retaining strips 36 and 38 are provided on the top surface of sheet 12. Central vertical retaining strip 40 is provided on sheet 12 in the embodiments, such as the embodiment illustrated in FIG. 4, that carry two columns of one or more items having a pre-determined size and essentially rectangular shape. No vertical retaining strips are provided on the top surface of sheet 12 in embodiments, such as the embodiment illustrated in FIG. 6, that are intended to carry one or more items of a size or shape, or both, that has not been pre-determined.

Vertical retaining strips 36, 38, and 40, illustrated in FIGS. 1, 4, and 5, are formed from a clear plastic sheet material. Other sheet materials, such as stiff paper, can be used. As best illustrated in FIG. 2, the outer vertical edges of left-hand and right-hand vertical retaining strips 36 and 38 are affixed to the top surface of sheet 12 with a suitable adhesive material, or by other suitable means, such that their respective inner vertical edges are free to bend upward from sheet 12. In like manner, the vertical axis of central vertical retaining strip 40, illustrated in FIG. 4, is affixed to sheet 12 such that both of its vertical edges are free to bend upward from sheet 12.

Having described the structure of the preferred embodiments of the carrier 10, the use of the embodiment of carrier 10 illustrated in FIG. 1 to advance address card 50 through a computer printer or word processor printer will now be described. First, the left-hand and right-hand vertical edges 52, 54 of card 50 are inserted between the sheet 12 and the left-hand and right-hand vertical retaining strips 36 and 38, respectively, as best illustrated in FIG. 2 to hold the card flat against the carrier to insure that the card moves smoothly through the printer. Then card 50 is pressed firmly onto adhesive strip 32. The vertical and horizontal grid lines 14 and 16 and horizontal and vertical grid lines 14 and 16 tell the secretary where the information to be printed should be located on the screen of the computer or word processor to be printed on the card.

The carrier with the card is fed into and advanced through the computer printer or word processor printer for printing the desired information onto card 50. After the carrier has passed through the computer printer or word processor printer, the edges of card 50 are removed from the retaining strips and the card is peeled off the adhesive strip. When not in use, the adhesive strip should be covered by a sheet of paper to allow the carriers to be stored without sticking together. The carrier 10 can be reused until the strip 32 of non-drying, non-setting, pressure sensitive, tacky adhesive has lost its tackiness. The other embodiments of the carrier 10 are used in a similar manner.

While the present invention has been disclosed in connection with its preferred embodiments, it should be understood that there may be other embodiments that fall within the scope and spirit of the invention as defined by the claims.

I claim:

1. A carrier for advancing one or more relatively small items such as envelopes, address cards, checks and the like through a computer printer or word processor printer having a single sheet feed mechanism controlled remotely by the computer or word processor, comprising a carrier sheet of a size that the feed mechanism of the printer is designed to handle, a plurality of strips of non-setting, non-drying, pressure sensitive, tacky adhesive attached to the carrier sheet to which the items can be attached and carried through the printer with the carrier sheet and thereafter removed from the carrier sheet, and grid means on the sheet to allow the computer or word processor to be programmed to print the desired information at the proper location on the items as the sheet is fed through the printer.

2. The carrier of claim 1 in which the carrier sheet is provided with a plurality of openings and the adhesive strips are attached to the back of the carrier sheet with a portion of the strip exposed through the openings.

3. The carrier of claim 1 further provided with means for holding the items flat against the carrier sheet as the carrier sheet moves through the printer.

4. The carrier of claim 1 in which the grid means includes horizontal location index numbers and vertical location index numbers printed on the carrier sheet, said horizontal location index numbers corresponding to the numbers on the margin and tab scale line displayed on the screen of a multi-purpose computer or dedicated word processor during word processing operations and said vertical location index numbers corresponding to the line numbers of a computer or word processor printer.

5. The carrier of claims 3, or 4 in which the means for holding the items flat against the carrier sheet include a pair of spaced, parallel flat, retaining strips of relatively stiff material attached to the sheet in a manner that allows the items to be printed to be slipped under the strips and held flat against the carrier sheet by the strips as the carrier sheet travels through the printer.

6. A carrier for advancing one or more relatively small items such as envelopes, address cards, checks, and the like through a computer printer or word processor printer, having a feed mechanism that is controlled remotely by the computer or word processor and that is capable of feeding only larger sheets of paper one at a time, comprising a carrier sheet of a size that the feed mechanism of the printers are designed to handle, a pair of spaced, parallel, flat, retaining strips of relatively stiff material attached to the sheet in a manner that allows the items to beprinted to be slipped under the strips and held flat against the carrier sheet by the strips as the carrier sheet travels through the printer, horizontal location index numbers and vertical location index numbers printed on the carrier sheet, said horizontal location index numbers corresponding to the numbers on the margin and tab scale line displayed on the screen of a multi-purpose computer or dedicated word processor during word processing operations and said vertical location index numbers corresponding to the line numbers of a computer or word processor printer to allow the information to be printed on the small items to be positioned on the screen so that the information will be printed on the items in the desired location, and a plurality of strips of non-setting, non-drying, pressure sensitive, tacky adhesive located between the parallel retaining strips to hold the items between the strips.

7. A carrier as recited in claim 6 in which the carrier sheet is provided with a plurality of openings and the adhesive strips are attached to the back of the carrier sheet with a portion of the strip exposed through the openings.

* * * * *